US009533494B2

(12) United States Patent
Edelen et al.

(10) Patent No.: US 9,533,494 B2
(45) **Date of Patent: *Jan. 3, 2017**

(54) ADDRESS ARCHITECTURE FOR FLUID EJECTION CHIP

(71) Applicant: FUNAI ELECTRIC CO., LTD., Osaka (JP)

(72) Inventors: John Glenn Edelen, Lexington, KY (US); Michael Marra, Lexington, KY (US)

(73) Assignee: FUNAI ELECTRIC CO., LTD, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/096,020

(22) Filed: Apr. 11, 2016

(65) Prior Publication Data

US 2016/0221334 A1 Aug. 4, 2016

Related U.S. Application Data

(63) Continuation of application No. 14/472,307, filed on Aug. 28, 2014, now Pat. No. 9,333,748.

(51) Int. Cl.

| | |
|---|---|
| ***B41J 2/05*** | (2006.01) |
| ***B41J 2/045*** | (2006.01) |
| ***B41J 2/14*** | (2006.01) |

(52) U.S. Cl.

CPC ..... *B41J 2/04541* (2013.01); *B41J 2/0458* (2013.01); *B41J 2/04501* (2013.01); *B41J 2/04543* (2013.01); *B41J 2/04586* (2013.01); *B41J 2/14427* (2013.01)

(58) Field of Classification Search

CPC ... B41J 2/04501; B41J 2/0455; B41J 2/04541; B41J 2/04545; B41J 2/04546; B41J 2/04521

See application file for complete search history.

(56) References Cited

U.S. PATENT DOCUMENTS

| | | | |
|---|---|---|---|
| 6,176,569 | B1 | 1/2001 | Anderson et al. |
| 6,318,828 | B1 | 11/2001 | Barbour et al. |
| 6,491,377 | B1 | 12/2002 | Cleland et al. |
| 6,652,055 | B2 | 11/2003 | Oikawa |
| 6,932,453 | B2 | 8/2005 | Feinn et al. |
| 9,333,748 | B2 * | 5/2016 | Edelen ..... B41J 2/14427 |
| 2009/0278878 | A1 | 11/2009 | Kubo et al. |
| 2009/0278890 | A1 | 11/2009 | Yamaguchi et al. |
| 2012/0154475 | A1 | 6/2012 | Uemura |

* cited by examiner

*Primary Examiner* — Geoffrey Mruk

(74) *Attorney, Agent, or Firm* — Amster, Rothstein & Ebenstein LLP

(57) ABSTRACT

A printhead including one or more fluid vias in fluid communication with a fluid supply, each of the one or more fluid vias being associated with a first number of heating elements, the heating elements being divided into groups of a second number of heating elements so as to form a number of primitive groups, and an electrical interface having at least one shift register that receives primitive address data to allow for selective application of electrical signals to the heating elements so that fluid is ejected from the printhead in accordance with image data, the number of primitive groups being dependent on the print resolution of the printhead so that a number of bits required for the at least one shift register to address each heater is independent of the print resolution of the printhead.

10 Claims, 7 Drawing Sheets

ADDRESS ARCHITECTURE FOR FLUID EJECTION CHIP

RELATED APPLICATION

This application is a continuation of and claims priority to U.S. Pat. No. 9,333,748, entitled ADDRESS ARCHITECTURE FOR FLUID EJECTION CHIP, filed Aug. 28, 2014, and is related to U.S. patent application Ser. No. 14/472,297, entitled CHIP LAYOUT TO ENABLE MULTIPLE HEATER CHIP VERTICAL RESOLUTIONS, filed Aug. 28, 2014, the contents of which are incorporated herein by reference in their entirety.

FIELD

The present invention relates generally to the design of micro-fluidic ejection chips, and in particular, to the systems and method for controlling micro-fluidic ejection chips.

BACKGROUND

In typical inkjet heater chip designs one of the first variables to be fixed is the vertical resolution of drop placement. From this starting point other properties such as the heater addressing matrix, input data register length, chip clock speeds etc. can be defined. Using this method, chips with similar properties except for vertical resolution often have incompatible electrical interfaces which require a unique ASIC, driver card and carrier for each design. While this may provide a cost effective bill of materials for a specific design, the savings can be offset by increased development resources and time to market. Therefore, this design approach is best suited for high volume designs with long product life cycles.

SUMMARY OF THE INVENTION

An object of the present invention is to provide an improved chip architecture that enables shorter development cycles and customized designs to fit individual customer needs.

A printhead according to an exemplary embodiment of the present invention comprises: one or more fluid vias in fluid communication with a fluid supply, each of the one or more fluid vias being associated with a first number of heating elements, the heating elements being divided into groups of a second number of heating elements so as to form a number of primitive groups; and an electrical interface comprising at least one shift register that receives primitive address data to allow for selective application of electrical signals to the heating elements so that fluid is ejected from the printhead in accordance with image data, the number of primitive groups being dependent on the print resolution of the printhead so that a number of bits required for the at least one shift register to address each heater is independent of the print resolution of the printhead.

An inkjet printer according to an exemplary embodiment of the present invention comprises: a housing; a carriage adapted to reciprocate along a shaft disposed within the housing; one or more printhead assemblies arranged on the carriage so that the one or more printhead assemblies eject ink onto a print medium as the carriage reciprocates along the shaft in accordance with a control mechanism, wherein at least one of the one or more printhead assemblies comprises: a printhead comprising: one or more ink vias in fluid communication with an ink supply, each of the one or more ink vias being associated with a first number of heating elements, the heating elements being divided into groups of a second number of heating elements so as to form a number of primitive groups; and an electrical interface comprising at least one shift register that receives primitive address data to allow for selective application of electrical signals to the heating elements so that ink is ejected from the printhead in accordance with image data, the number of primitive groups being dependent on the print resolution of the printhead so that a number of bits required for the at least one shift register to address each heater is independent of the print resolution of the printhead.

In at least one exemplary embodiment, for each of the one or more fluid vias, the first number of heating elements are arranged in a first column on one side of the fluid via and in a second column on another side of the fluid via.

In at least one exemplary embodiment, the number of primitive groups is calculated according to the following equation: (the first number of heating elements)/(the second number of heating elements).

In at least one exemplary embodiment, the first number of heating elements is calculated according to the following equation: (resolution per via)(print swath), where units of print swath is inches.

In at least one exemplary embodiment, the printhead has a print resolution of 1200 dpi and the number of primitive groups is 40.

In at least one exemplary embodiment, the printhead has a print resolution of 600 dpi and the number of primitive groups is 20.

In at least one exemplary embodiment, the printhead has a print resolution of 300 dpi and the number of primitive groups is 10.

In at least one exemplary embodiment, the printhead has a print resolution of 300 dpi, 600 dpi or 1200 dpi and the number of bits is 40.

In at least one exemplary embodiment, the second number of heating elements is 34.

In at least one exemplary embodiment, the second number of heating elements is within a range of 8 to 40.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
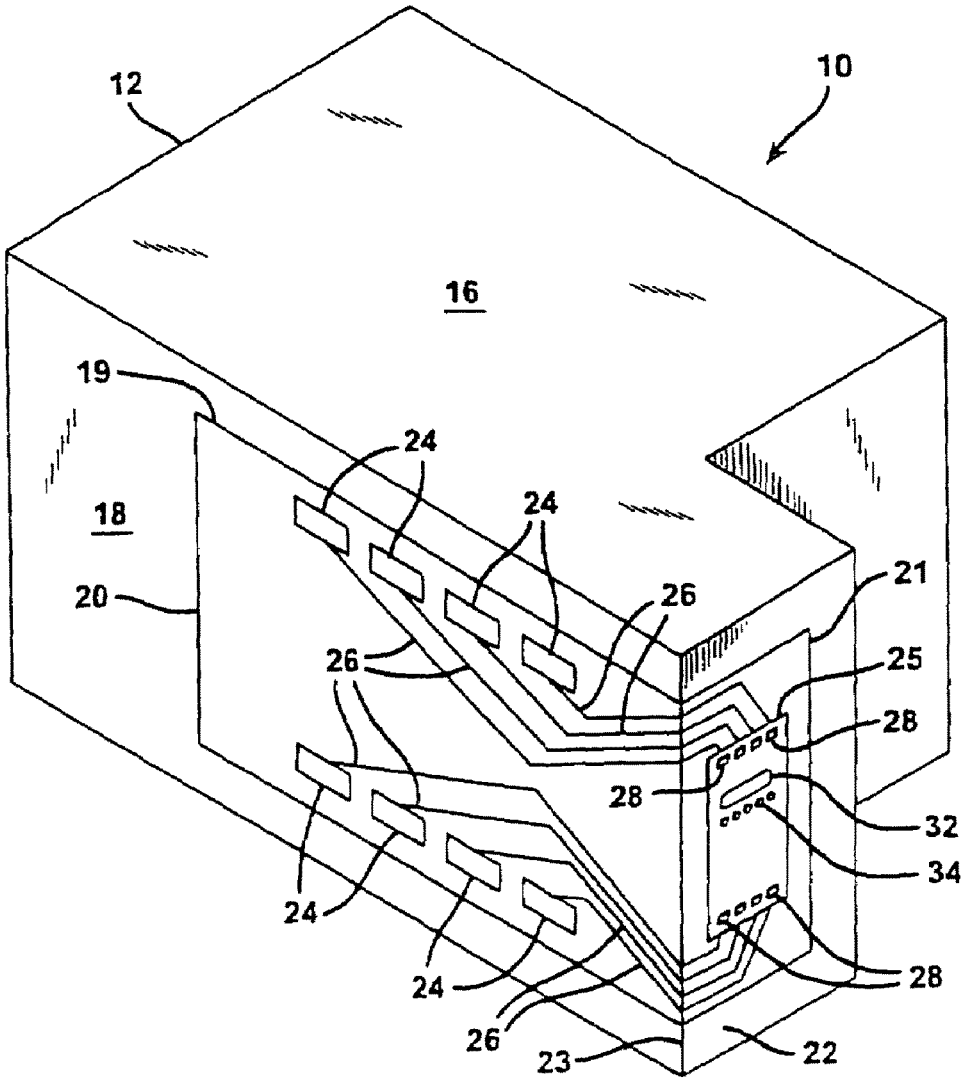
FIG. 1 is a perspective view of a conventional inkjet printhead.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

The address architecture according to exemplary embodiments of the present invention enables the design of heater chips of differing resolutions which can be controlled using a common electrical interface. This allows for realization of multiple vertical drop resolutions from a common base chip design. The invention enables significant improvements over conventional inkjet heater chip designs. For example, a common electrical interface can be used between chips of different resolutions. This simplifies print engine development and also allows for more flexibility during manufacturing since a single base chip can be targeted to multiple resolutions as the business needs dictate.

One aspect of such a design is that as the heater resolution changes, the data stream to address the heaters may also change. It is desirable to design a single print engine capable of driving heads of multiple resolutions without impacting the electrical interface.

With reference to FIG. 1, an inkjet printhead of the present invention is shown generally as 10. The printhead 10 has a housing 12 formed of any suitable material for holding ink. Its shape can vary and often depends upon the external device that carries or contains the printhead. The housing has at least one compartment 16 internal thereto for holding an initial or refillable supply of ink. In one embodiment, the compartment has a single chamber and holds a supply of black ink, photo ink, cyan ink, magenta ink or yellow ink. In other embodiments, the compartment has multiple chambers and contains three supplies of ink. Preferably, it includes cyan, magenta and yellow ink. In still other embodiments, the compartment contains plurals of black, photo, cyan, magenta or yellow ink. It will be appreciated, however, that while the compartment 16 is shown as locally integrated within a housing 12 of the printhead, it may alternatively connect to a remote source of ink and receive supply from a tube, for example.

Adhered to one surface 18 of the housing 12 is a portion 19 of a flexible circuit, especially a tape automated bond (TAB) circuit 20. The other portion 21 of the TAB circuit 20 is adhered to another surface 22 of the housing. In this embodiment, the two surfaces 18, 22 are perpendicularly arranged to one another about an edge 23 of the housing.

The TAB circuit 20 supports a plurality of input/output (I/O) connectors 24 thereon for electrically connecting a heater chip 25 to an external device, such as a printer, fax machine, copier, photo-printer, plotter, all-in-one, etc., during use. Pluralities of electrical conductors 26 exist on the TAB circuit 20 to electrically connect and short the I/O connectors 24 to the input terminals (bond pads 28) of the heater chip 25. Those skilled in the art know various techniques for facilitating such connections. For simplicity, FIG. 1 only shows eight I/O connectors 24, eight electrical conductors 26 and eight bond pads 28 but present day printheads have much larger quantities and any number is equally embraced herein. Still further, those skilled in the art should appreciate that while such number of connectors, conductors and bond pads equal one another, actual printheads may have unequal numbers.

The heater chip 25 contains a column 34 of a plurality of fluid firing elements that serve to eject ink from compartment 16 during use. The fluid firing elements may embody thermally resistive heater elements (heaters for short) formed as thin film layers on a silicon substrate or piezoelectric elements despite the thermal technology implication derived from the name heater chip. For simplicity, the pluralities of fluid firing elements in column 34 are shown adjacent an ink via 32 as a row of five dots but in practice may include several hundred or thousand fluid firing elements. As described below, vertically adjacent ones of the fluid firing elements may or may not have a lateral spacing gap or stagger there between. In general, the fluid firing elements have vertical pitch spacing comparable to the dots-per-inch resolution of an attendant printer. Some examples include spacing of $1/300$th, $1/600$th, $1/1200$th, $1/2400$th or other of an inch along the longitudinal extent of the via. To form the vias, many processes are known that cut or etch the via 32 through a thickness of the heater chip. Some of the more preferred processes include grit blasting or etching, such as wet, dry, reactive-ion-etching, deep reactive-ion-etching, or other. A nozzle plate (not shown) has orifices thereof aligned with each of the heaters to project the ink during use. The nozzle plate may be a thin film layer attached with an adhesive or epoxy.

Figure 2:
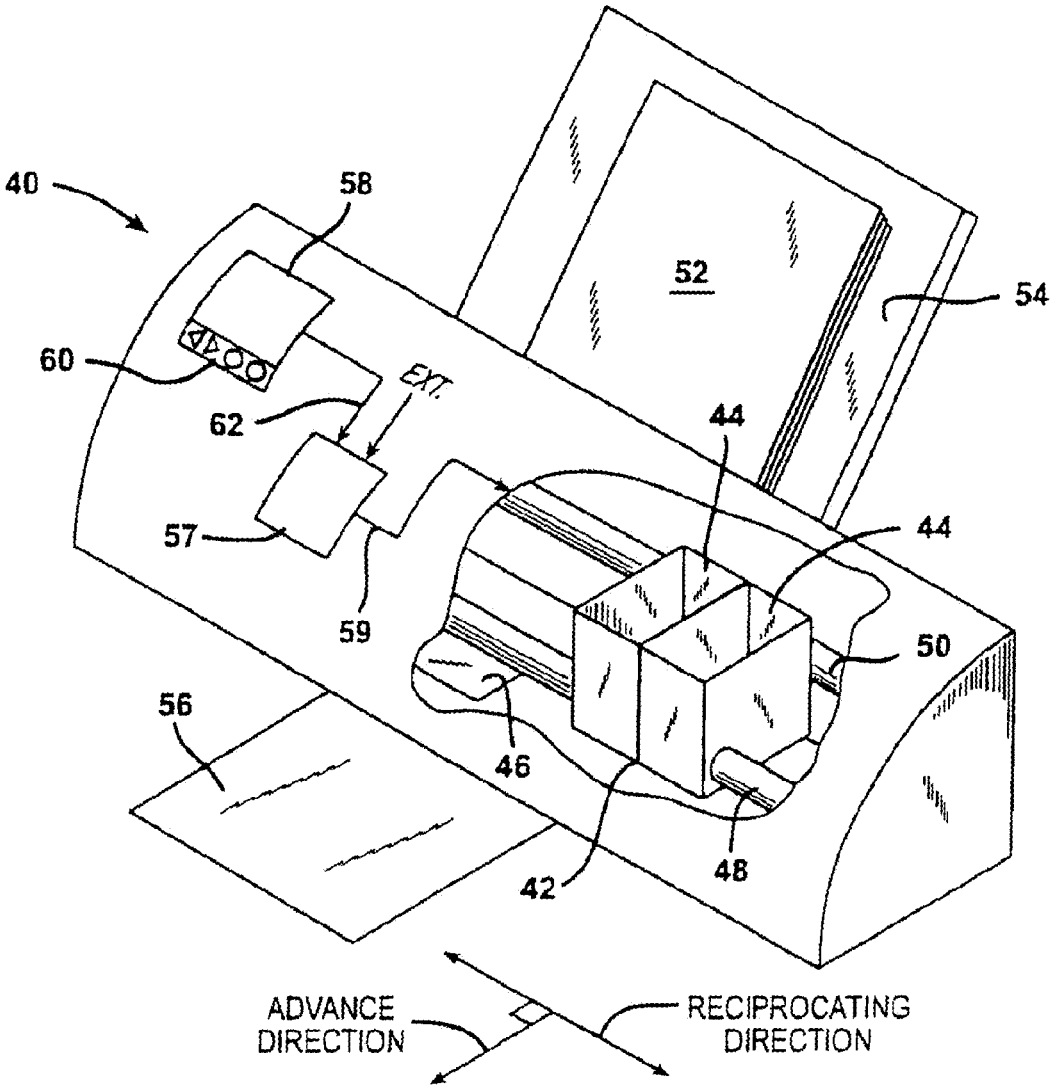
FIG. 2 is a perspective view of a conventional inkjet printer.

With reference to FIG. 2, an external device in the form of an inkjet printer for containing the printhead 10 is shown generally as 40. The printer 40 includes a carriage 42 having a plurality of slots 44 for containing one or more printheads 10. The carriage 42 reciprocates (in accordance with an output 59 of a controller 57) along a shaft 48 above a print zone 46 by a motive force supplied to a drive belt 50 as is well known in the art. The reciprocation of the carriage 42 occurs relative to a print medium, such as a sheet of paper 52 that advances in the printer 40 along a paper path from an input tray 54, through the print zone 46, to an output tray 56.

While in the print zone, the carriage 42 reciprocates in the Reciprocating Direction generally perpendicularly to the paper 52 being advanced in the Advance Direction as shown by the arrows. Ink drops from compartment 16 (FIG. 1) are caused to be ejected from the heater chip 25 at such times pursuant to commands of a printer microprocessor or other controller 57. The timing of the ink drop emissions corresponds to a pattern of pixels of the image being printed. Often times, such patterns become generated in devices electrically connected to the controller 57 (via Ext. input) that reside externally to the printer and include, but are not limited to, a computer, a scanner, a camera, a visual display unit, a personal data assistant, or other.

To print or emit a single drop of ink, the fluid firing elements (the dots of column 34, FIG. 1) are uniquely addressed with a small amount of current to rapidly heat a small volume of ink. This causes the ink to vaporize in a local ink chamber between the heater and the nozzle plate and eject through, and become projected by, the nozzle plate towards the print medium. The fire pulse required to emit such ink drop may embody a single or a split firing pulse and is received at the heater chip on an input terminal (e.g., bond pad 28) from connections between the bond pad 28, the electrical conductors 26, the I/O connectors 24 and controller 57. Internal heater chip wiring conveys the fire pulse from the input terminal to one or many of the fluid firing elements.

A control panel 58, having user selection interface 60, also accompanies many printers as an input 62 to the controller 57 to provide additional printer capabilities and robustness.

Figure 3:
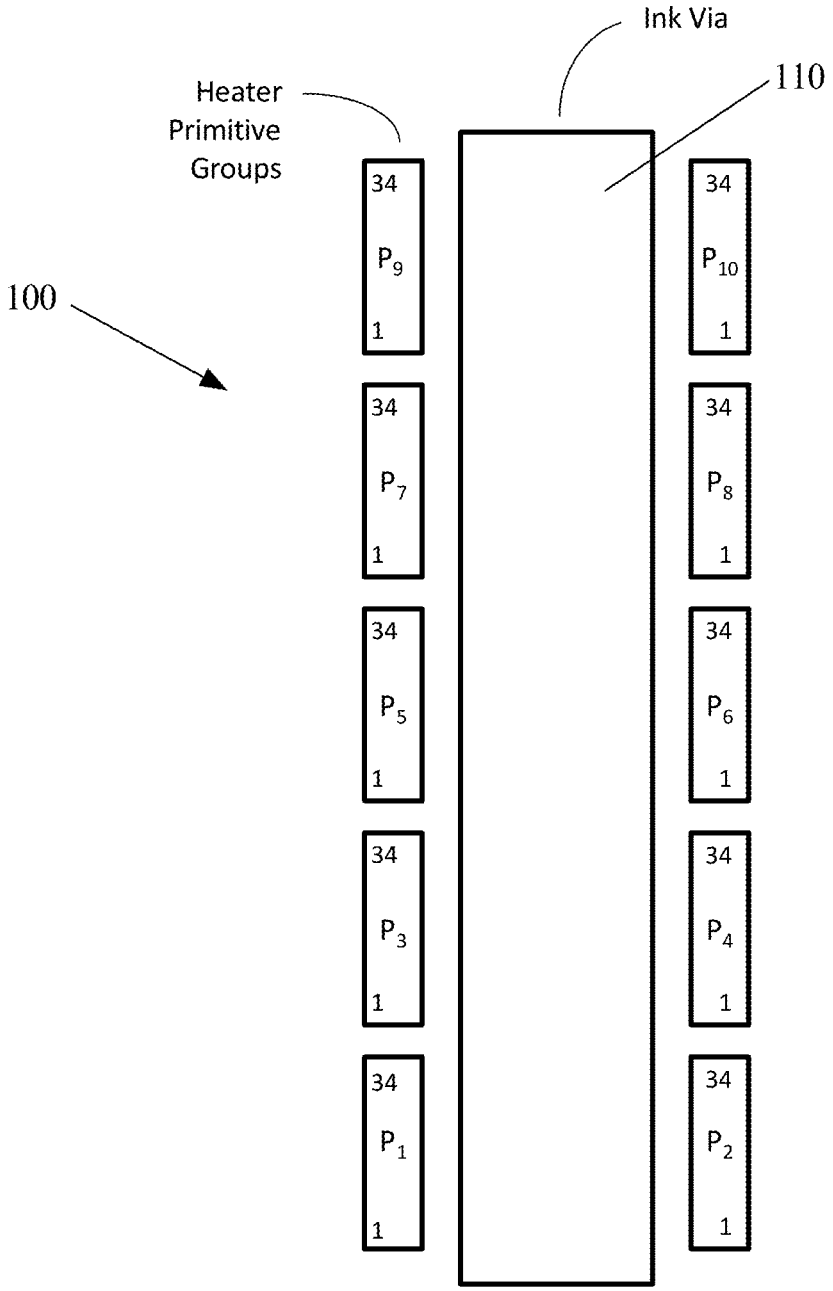
FIG. 3 is a block diagram showing the layout of a printhead according to an exemplary embodiment of the present invention.

FIG. 3 is a block diagram showing the layout of a printhead, generally designated by reference number 100, according to an exemplary embodiment of the present invention. Each heater A on the printhead 100 has a unique address having at minimum a two dimensional address matrix. The printhead 100 includes a fluid via 110 and groups P1-P10 (also referred to herein as "primitive groups") of heaters A. The total number of heaters on the printhead is therefore P×A. In the examples shown in FIG. 3, each group P1-P10 includes 34 heaters for a total of 340 heaters for the via 110.

Table 1 illustrates three possible configurations for a 300 dpi, 600 dpi and 1200 dpi printhead. In each case, the print swath is about 1.13 inches and the number of heater addresses A is fixed at 34. It should be appreciated that the number of heaters per group, and hence the number of addresses A, need not be 34, and in other exemplary embodiments the number of heaters per group may be more or less than 34. For example, the number of heaters per group may be within a range of 8 to 40. As shown in Table 1, the only difference in addressing for the three chips is the number of primitives or P groups.

TABLE 1

| | 300 | 600 | 1200 |
|---|---|---|---|
| Number of Heaters per Column | 170 | 340 | 680 |
| Resolution per Via (dpi) | 300 | 600 | 1200 |
| Resolution per Column (dpi) | 150 | 300 | 600 |
| Heater Spacing (um) | 169.3 | 84.7 | 4.23 |
| Print Swath (in) | 1.136 | 1.135 | 1.133 |
| Number of Heaters per Via | 340 | 680 | 1360 |
| Number of Addresses | 34 | 34 | 34 |
| Number of Primitives | 10 | 20 | 40 |

By fixing the number of addresses at 34, the length of the on chip register required to contain the encoded value is fixed at 6 bits (so as to encode the decimal value of each of the 34 addresses). This will be the case for all three resolutions, thereby allowing for a common electrical interface for the address data.

Figure 4:
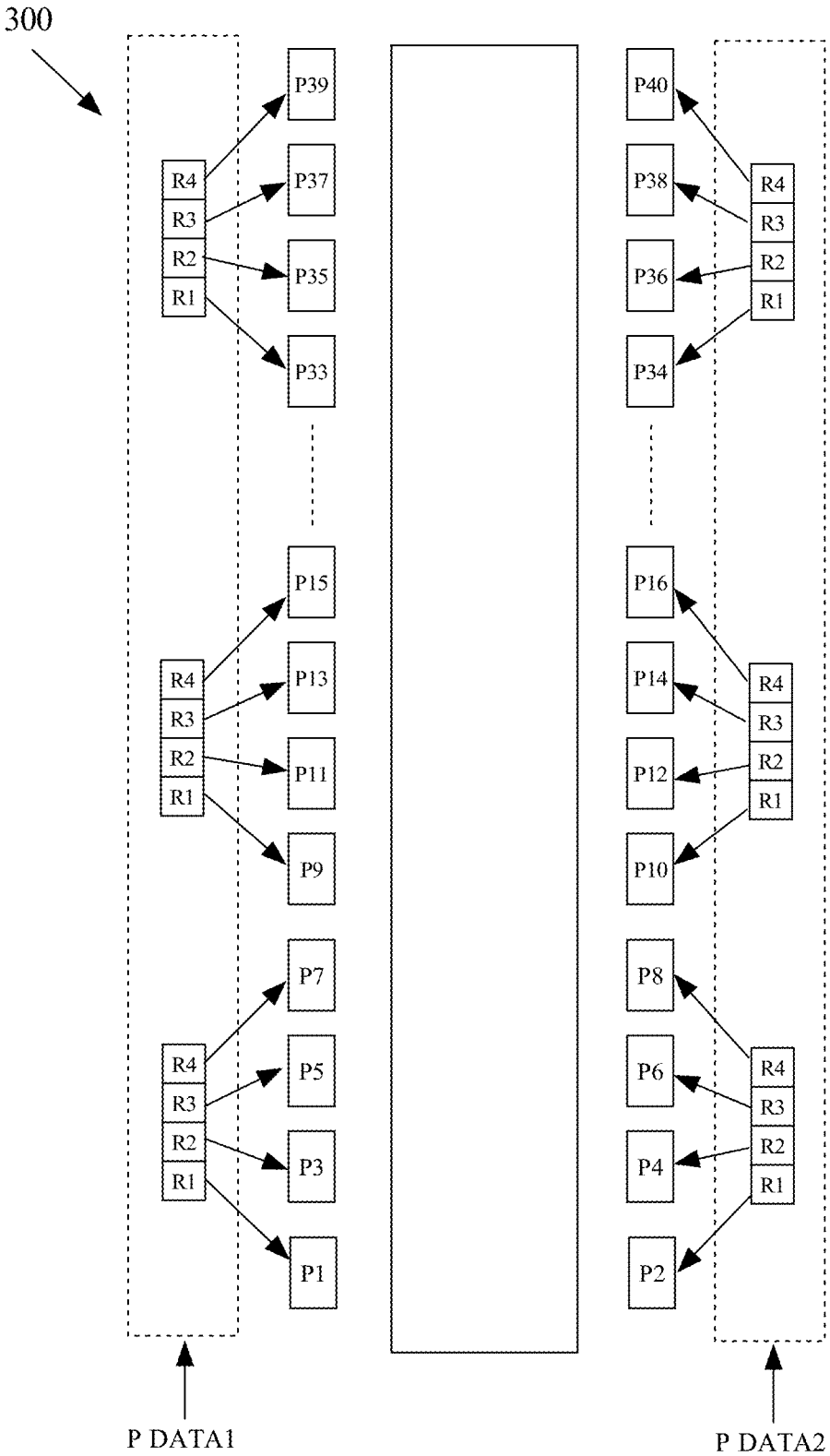
FIG. 4 is a block diagram showing the layout of a printhead according to another exemplary embodiment of the present invention.

In the 1200 dpi case, the number of primitives is set at 40, so that in order to address each primitive, a total of 40 bits is required. FIG. 4 illustrates the addressing for the 1200 dpi case. As shown, the primitive groups P1-P40 of printhead 300 are addressed using two shift registers, with one bit for each primitive group. There are a total of 40 $P_{data}$ bits divided into the two registers Shift Register 1 and Shift Register 2 for 20 bits per register.

Figure 5:
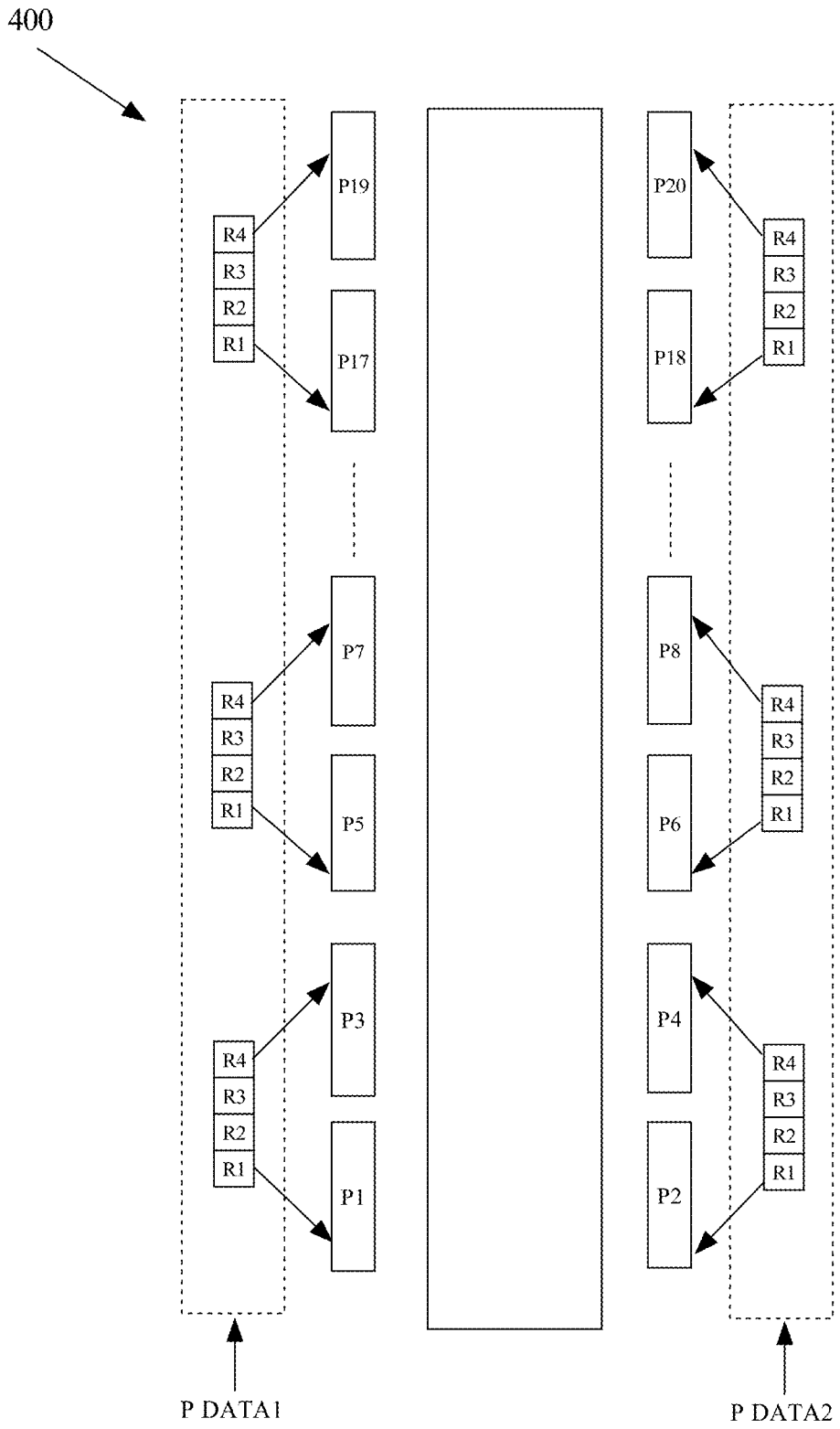
FIG. 5 is a block diagram showing the layout of a printhead according to another exemplary embodiment of the present invention.

FIG. 5 illustrates the addressing for the 600 dpi case. Since half as many addresses are needed as compared to the 1200 dpi case, the number of primitives of printhead 400 can be set at 20, which is half as many primitives used in the 1200 dpi case. The $P_{data}$ bit shift register used in the 1200 dpi case can also be used in the 600 dpi case. However, each four element R1-R4 group within the shift register can now be used to address a corresponding pair of primitives instead of a corresponding group of four primitives.

Figure 6:
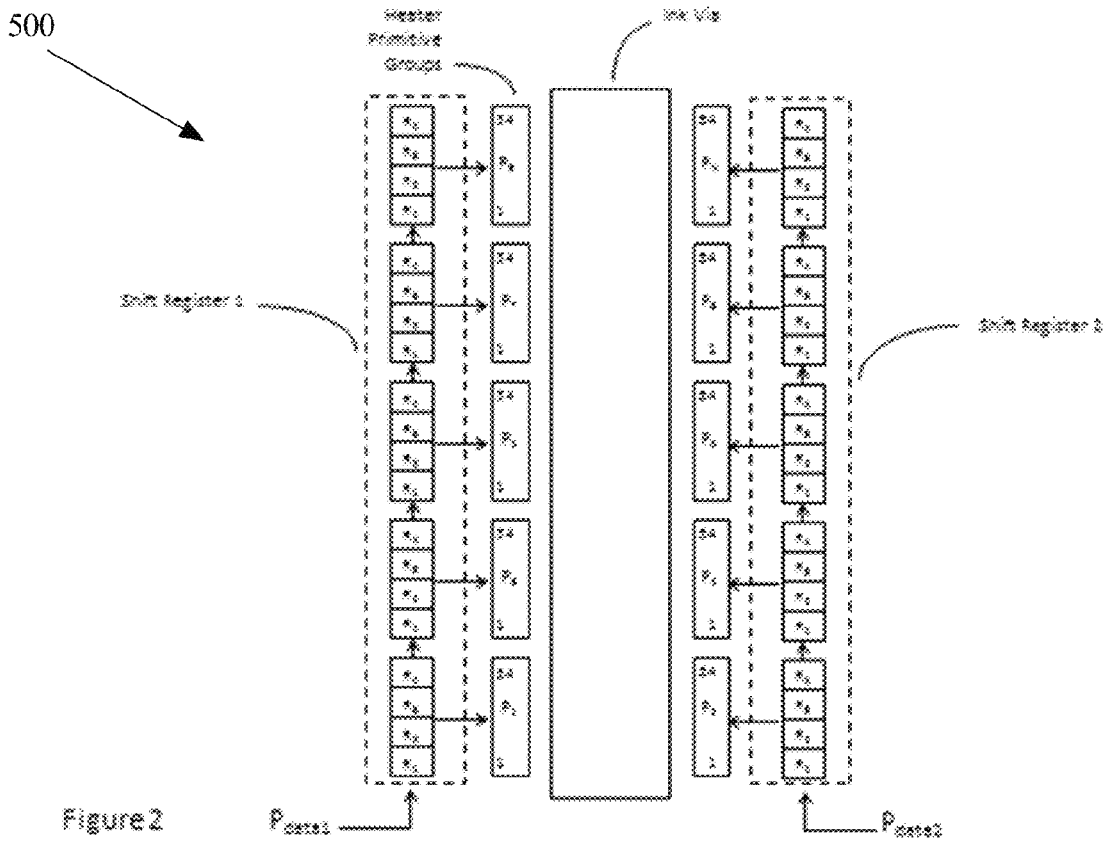
FIG. 6 is a block diagram showing the layout of a printhead according to another exemplary embodiment of the present invention.

FIG. 6 illustrates the addressing for the 300 dpi case. Since only ¼ as many addresses are needed as compared to the 1200 dpi case, the number of primitives of printhead 500 can be set at 10, which is ¼ as many primitives used in the 1200 dpi case. The $P_{data}$ bit shift register used in the 1200 dpi case can also be used in the 300 dpi case. However, each four element R1-R4 group within the shift register can now be used to address a single primitive instead of a corresponding group of four primitives.

Figure 7:
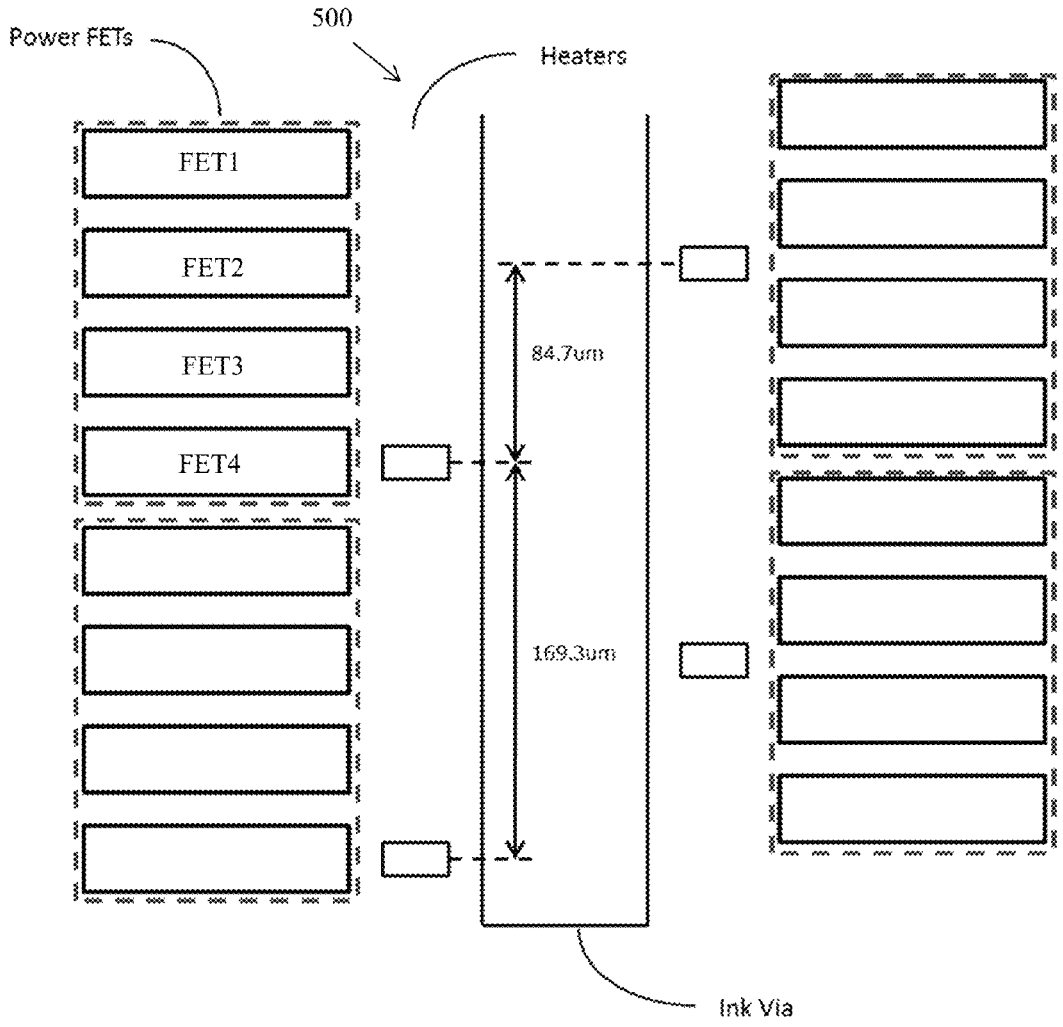
FIG. 7 is a block diagram showing the layout of a printhead according to another exemplary embodiment of the present invention.

Further exploring the 300 dpi case, and as described in U.S. patent application Ser. No. 14/472,297, the contents of which are incorporated herein by reference in their entirety, FIG. 7 shows four power FETs, FET1, FET2, FET3 and FET4 connected in parallel and available to drive a single heater element A. Each power FET has a corresponding pre-drive circuit (not shown) used to charge (turn on) and discharge (turn off) the FET to switch heater current when addressed. By maintaining a unique pre-drive and register bit for each FET and tying the FETs in parallel, the heater chip driving circuit can now select the drive strength which best fits the application. The ability to select the drive strength allows the heater chip control circuit to shape the firing current rise and fall times.

Table 2 shows the values for selecting primitive groups for the 300, 600 and 1200 dpi cases. Shown are the minimum values needed to select all primitives where the X parameters represent cases where the drive strength could be increased if desired.

TABLE 2

| | | R20 | R19 | R18 | R17 | R16 | R15 | R14 | R13 | R12 | R11 | R10 | R9 | R8 | R7 | R6 | R5 | R4 | R3 | R2 | R1 |
|---|---|---|---|---|---|---|---|---|---|---|---|---|---|---|---|---|---|---|---|---|---|
| 1200 dpi | Pdata1 | 1 | 1 | 1 | 1 | 1 | 1 | 1 | 1 | 1 | 1 | 1 | 1 | 1 | 1 | 1 | 1 | 1 | 1 | 1 | 1 |
| | Pdata2 | 1 | 1 | 1 | 1 | 1 | 1 | 1 | 1 | 1 | 1 | 1 | 1 | 1 | 1 | 1 | 1 | 1 | 1 | 1 | 1 |
| 600 dpi | Pdata1 | X | 1 | X | 1 | X | 1 | X | 1 | X | 1 | X | 1 | X | 1 | X | 1 | X | 1 | X | 1 |
| | Pdata2 | X | 1 | X | 1 | X | 1 | X | 1 | X | 1 | X | 1 | X | 1 | X | 1 | X | 1 | X | 1 |
| 300 dpi | Pdata1 | X | X | X | 1 | X | X | X | 1 | X | X | X | 1 | X | X | X | 1 | X | X | X | 1 |
| | Pdata2 | X | X | X | 1 | X | X | X | 1 | X | X | X | 1 | X | X | X | 1 | X | X | X | 1 |

Further considering the 300 dpi case, Table 3 shows the values for selecting minimum drive strength while Table 4 shows the values for selecting maximum drive strength.

TABLE 3

| | | R20 | R19 | R18 | R17 | R16 | R15 | R14 | R13 | R12 | R11 | R10 | R9 | R8 | R7 | R6 | R5 | R4 | R3 | R2 | R1 |
|---|---|---|---|---|---|---|---|---|---|---|---|---|---|---|---|---|---|---|---|---|---|
| 300 dpi | Pdata1 | 0 | 0 | 0 | 1 | 0 | 0 | 0 | 1 | 0 | 0 | 0 | 1 | 0 | 0 | 0 | 1 | 0 | 0 | 0 | 1 |
| | Pdata2 | 0 | 0 | 0 | 1 | 0 | 0 | 0 | 1 | 0 | 0 | 0 | 1 | 0 | 0 | 0 | 1 | 0 | 0 | 0 | 1 |

TABLE 4

| | | R20 | R19 | R18 | R17 | R16 | R15 | R14 | R13 | R12 | R11 | R10 | R9 | R8 | R7 | R6 | R5 | R4 | R3 | R2 | R1 |
|---|---|---|---|---|---|---|---|---|---|---|---|---|---|---|---|---|---|---|---|---|---|
| 300 dpi | Pdata1 | 1 | 1 | 1 | 1 | 1 | 1 | 1 | 1 | 1 | 1 | 1 | 1 | 1 | 1 | 1 | 1 | 1 | 1 | 1 | 1 |
| | Pdata2 | 1 | 1 | 1 | 1 | 1 | 1 | 1 | 1 | 1 | 1 | 1 | 1 | 1 | 1 | 1 | 1 | 1 | 1 | 1 | 1 |

In this example, to maintain a common electrical interface the Pdata register for all three cases would be fixed to the 20 bits.

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A method of inkjet printing, comprising:

transmitting primitive address data to at least one shift register of a printhead, the at least one shift register having a number of bits dependent upon a number of primitive groups of heating elements of the printhead, each primitive group comprising a first number of heating elements of a total, second number of heating elements of the printhead, the number of bits independent of a print resolution of the printhead such that the printhead is configured for control by an electrical interface that is common for a plurality of different print resolutions of the printhead; and selectively applying, by the at least one shift register, one or more electrical signals to the heating elements to eject ink supplied by one or more fluid vias in fluid communication with the heating elements.

2. The method of claim 1, wherein the number of primitive groups is determined by the following equation: (the first number of heating elements)/(the second number of heating elements).

3. The method of claim 2, wherein the first number of heating elements is determined by the following equation: (resolution per via)×(print swath), where units of print swath is inches.

4. The method of claim 1, wherein the printhead has a print resolution of 1200 dpi and the number of primitive groups is 40.

5. The method of claim 1, wherein the printhead has a print resolution of 600 dpi and the number of primitive groups is 20.

6. The method of claim 1, wherein the printhead has a print resolution of 300 dpi and the number of primitive groups is 10.

7. The method of claim 1, wherein the printhead has a print resolution of 300 dpi, 600 dpi, or 1200 dpi and the number of bits is 40.

8. The method of claim 1, wherein the second number of heating elements is 34.

9. The method of claim 1, wherein the second number of heating elements is within a range of 8 to 40.

10. The method of claim 1, wherein the at least one shift register is provided on the substrate before the step of arranging the first number of heating elements on the substrate into the number of primitive groups.

* * * * *